US009323198B2

(12) United States Patent
Iesaki

(10) Patent No.: US 9,323,198 B2
(45) Date of Patent: Apr. 26, 2016

(54) MOTOR CONTROL APPARATUS AND IMAGE FORMING APPARATUS

(75) Inventor: Kenichi Iesaki, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 36 days.

(21) Appl. No.: 13/362,083

(22) Filed: Jan. 31, 2012

(65) Prior Publication Data

US 2012/0251213 A1 Oct. 4, 2012

(30) Foreign Application Priority Data

Mar. 31, 2011 (JP) ..... 2011-079083

(51) Int. Cl.
*G03G 15/00* (2006.01)
*H02P 1/04* (2006.01)

(52) U.S. Cl.
CPC ..... *G03G 15/5004* (2013.01)

(58) Field of Classification Search
USPC ..... 318/560, 568.17, 652, 127, 318/400.14–400.33, 268, 282, 369, 437, 318/466, 571; 355/18, 51, 67, 68
See application file for complete search history.

(56) References Cited

U.S. PATENT DOCUMENTS 7,462,998 B2 12/2008 Akiyama
7,837,194 B2 * 11/2010 Terada ..... H04N 1/0057 271/114
2006/0071416 A1 * 4/2006 Mizuno ..... B65H 5/06 271/258.01
2007/0075670 A1 4/2007 Akiyama
2011/0242620 A1 * 10/2011 Yamamoto ..... H04N 1/00814 358/488
2012/0081062 A1 4/2012 Iesaki

FOREIGN PATENT DOCUMENTS

| | | | |
|---|---|---|---|
| JP | S62-60403 A | | 3/1987 |
| JP | 04024809 A | * | 1/1992 |
| JP | H04-24809 A | | 1/1992 |
| JP | H05-161371 A | | 6/1993 |
| JP | H05161371 A | * | 6/1993 |
| JP | 07-302121 | | 11/1995 |
| JP | 2003-289685 A | | 10/2003 |
| JP | 2007-086904 | | 4/2007 |
| JP | 2007-221940 | | 8/2007 |

(Continued)

OTHER PUBLICATIONS

Pending U.S. Appl. No. 13/238,216, filed Sep. 21, 2011.

(Continued)

*Primary Examiner* — Paul Ip
*Assistant Examiner* — Said Bouziane
(74) *Attorney, Agent, or Firm* — Banner & Witcoff, Ltd.

(57) ABSTRACT

A motor control apparatus including a motor control unit and a signal output unit that outputs a signal corresponding to rotation of the motor to displace an object to be driven to a target stop position, the motor control unit includes: a first control unit that estimates a current upper limit and determines a first control input; a second control unit that determines a second control input and controls the motor to stop the object to be driven at the target stop position; a first calculation unit calculates a necessary amount for stop, a second calculation unit that calculates a remaining displacement amount, a switching unit, enable the first control unit or the second control unit to control the motor with switching; based on the necessary amount for stop and the remaining displacement amount.

8 Claims, 7 Drawing Sheets

(56) References Cited

FOREIGN PATENT DOCUMENTS

| | | |
|---|---|---|
| JP | 2010-222527 | 10/2010 |
| JP | 2012-080648 A | 4/2012 |

OTHER PUBLICATIONS

JP Office Action mailed Jul. 23, 2013, JP Appln. 2011-079083, English translation.

* cited by examiner

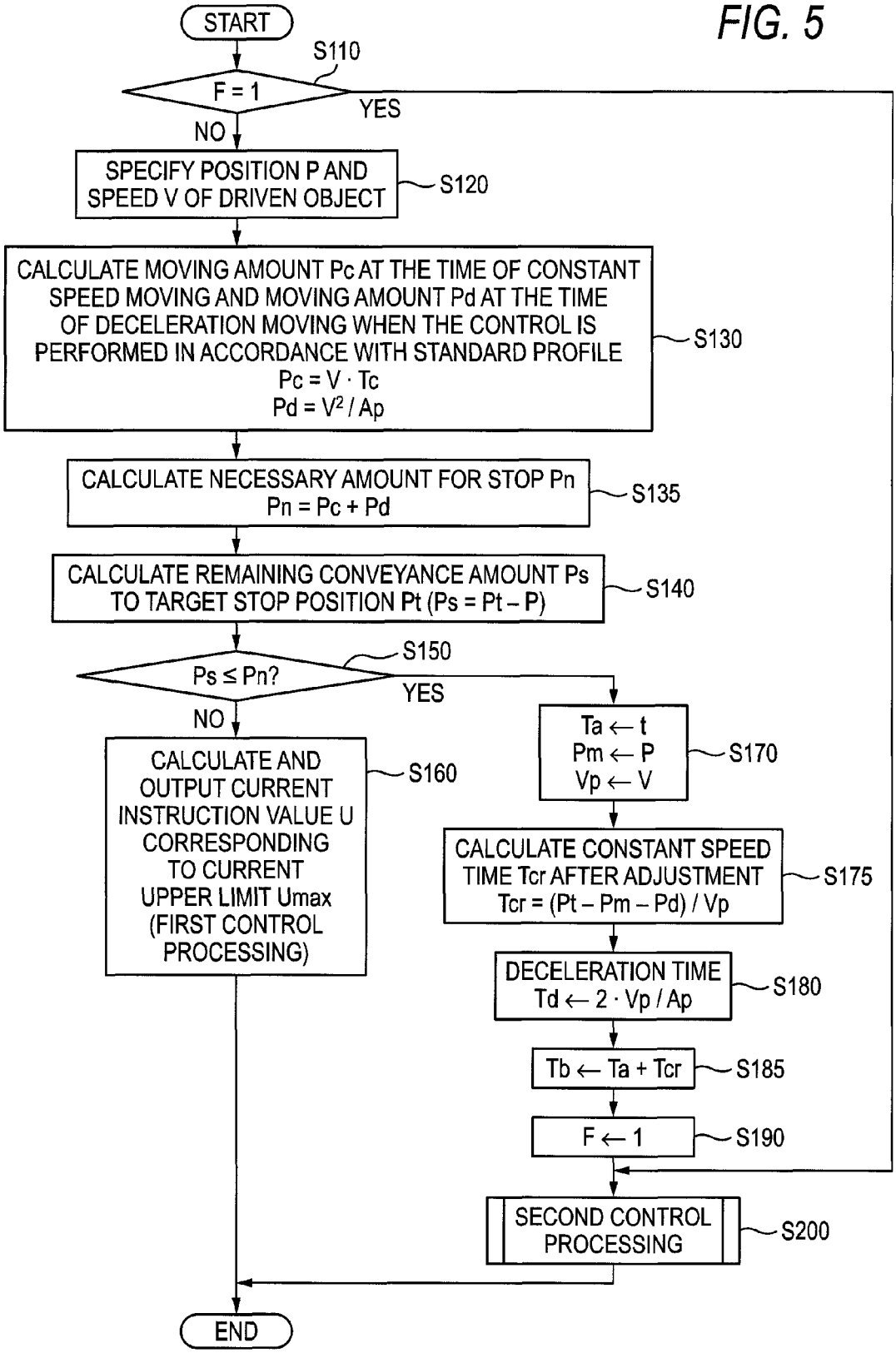
FIG. 5
START
S110
F = 1
YES
NO
SPECIFY POSITION P AND SPEED V OF DRIVEN OBJECT
S120
CALCULATE MOVING AMOUNT Pc AT THE TIME OF CONSTANT SPEED MOVING AND MOVING AMOUNT Pd AT THE TIME OF DECELERATION MOVING WHEN THE CONTROL IS PERFORMED IN ACCORDANCE WITH STANDARD PROFILE
Pc = V · Tc
Pd = V² / Ap
S130
CALCULATE NECESSARY AMOUNT FOR STOP Pn
Pn = Pc + Pd
S135
CALCULATE REMAINING CONVEYANCE AMOUNT Ps TO TARGET STOP POSITION Pt (Ps = Pt – P)
S140
S150
Ps ≤ Pn?
YES
NO
CALCULATE AND OUTPUT CURRENT INSTRUCTION VALUE U CORRESPONDING TO CURRENT UPPER LIMIT Umax (FIRST CONTROL PROCESSING)
S160
Ta ← t
Pm ← P
Vp ← V
S170
CALCULATE CONSTANT SPEED TIME Tcr AFTER ADJUSTMENT
Tcr = (Pt – Pm – Pd) / Vp
S175
DECELERATION TIME
Td ← 2 · Vp / Ap
S180
Tb ← Ta + Tcr
S185
F ← 1
S190
SECOND CONTROL PROCESSING
S200
END

MOTOR CONTROL APPARATUS AND IMAGE FORMING APPARATUS

CROSS-REFERENCE TO RELATED APPLICATION

This application claims priority from Japanese Patent Application No. 2011-079083 filed on Mar. 31, 2011, the entire subject matter of which is incorporated herein by reference.

TECHNICAL FIELD

This disclosure relates to a motor control apparatus and an image forming apparatus.

BACKGROUND

In the related motor control apparatus, a deviation is generated between a motor driving current and an actual motor driving current caused due to current degradation by counter-electromotive force, so that control accuracy is deteriorated. In order to solve a problem of the deterioration of control accuracy, a related motor control apparatus sets a maximum limit value of a control duty based on a saturation current changing depending on speeds.

SUMMARY

On the other hand, the bang-bang control is a control method that is excellent in driving a driven object at high speed. However, it is a simple control method, so that it is difficult to stop the driven object at a target position with high precision. In the meantime, regarding a technology for stopping the driven object at a target position in high accuracy, feed-back controls based on a target profile is known. However, even when the method of setting the limit value of a control input based on the saturation current is adopted for the feed-back control, there is a limit on the control of the driven object at high speed and in high accuracy.

In view of the above, this disclosure is to provide a technology capable of stopping an object to be driven (driven object) at a target stop position at higher speed and in higher precision.

In view of the above, a motor control apparatus of the this disclosure that controls a motor, based on an output signal of a signal output unit outputting a signal depending on rotation of the motor, and thus displaces an object to be driven, which is driven by the motor, to a target stop position. A motor control unit controlling the motor includes a first control unit, a second control unit, a switching unit, a first calculation unit and a second calculation unit.

The first control unit estimates a current upper limit, which is an upper limit of a current that be able to be input to the motor and is adjusted based on current degradation by counter-electromotive force, based on the output signal of the signal output unit. The first control unit determines a control input corresponding to the estimated current upper limit as a control input to be applied to the motor, thereby controlling the motor.

The second control unit determines the control input to be applied to the motor based on a displacement amount or speed, as a moving amount of the motor or object to be driven specified from the output signal of the signal output unit, and a target value of the moving amount, thereby controlling the motor. By this control, the object to be driven is stopped at the target stop position.

The switching unit enables the first control unit to control the motor, until a starting condition of the motor control by the second control unit is satisfied. And, the switching unit enables the second control unit to control the motor instead of the first control unit, after the starting condition of the motor control by the second control unit is satisfied. The switching unit determines whether the starting condition of the motor control is satisfied, based on calculation results of the first calculation unit and the second calculation unit.

The first calculation unit calculates a necessary amount for stop, which is a displacement amount of the object to be driven from a start time of the motor control by the second control unit to a stop time of the object to be driven, in case that the motor control by the second control unit starts from that time and the object to be driven is thus stopped in a specific control pattern, based on the speed specified by the output signal of the signal output unit. In the meantime, the second calculation unit calculates a remaining displacement amount of the object to be driven from that time to a time, at which the object to be driven reaches the target stop position, based on the displacement amount specified from the output signal of the signal output unit.

The switching unit determines whether the starting condition of the motor control by the second control unit is satisfied, based on the necessary amount for stop and the remaining displacement amount calculated as described above.

According to the motor control apparatus configured as described above, the necessary amount for stop is calculated, based on the speed of the motor or object to be driven specified from the output signal of the signal output unit, and the motor control is switched from the control by the first control unit to the control by the second control unit, based on the necessary amount for stop and the remaining displacement amount. Therefore, it is possible to continue the motor control by the first control unit as long as possible within a range in which a bad influence is not made on the stop accuracy, thereby displacing the object to be driven at high speed corresponding to the maximum capability of the motor or equivalent thereto. Also, the motor control is possible to be switched to the motor control by the second control unit at an appropriate timing depending on the speed, so that it is possible to stop the object to be driven at the target stop position with high precision.

Thus, according to the motor control apparatus, it is possible to displace the object to be driven to the target stop position at higher speed and in higher precision and is possible to stop the same at the target stop position.

BRIEF DESCRIPTION OF THE DRAWINGS

The foregoing and additional features and characteristics of this disclosure will become more apparent from the following detailed descriptions considered with the reference to the accompanying drawings, wherein:

FIG. 5 is a flowchart illustrating processing executed by a motor control unit;

DETAILED DESCRIPTION

Hereinafter, illustrative embodiments of this disclosure will be described with reference to the drawings.

Figure 1:
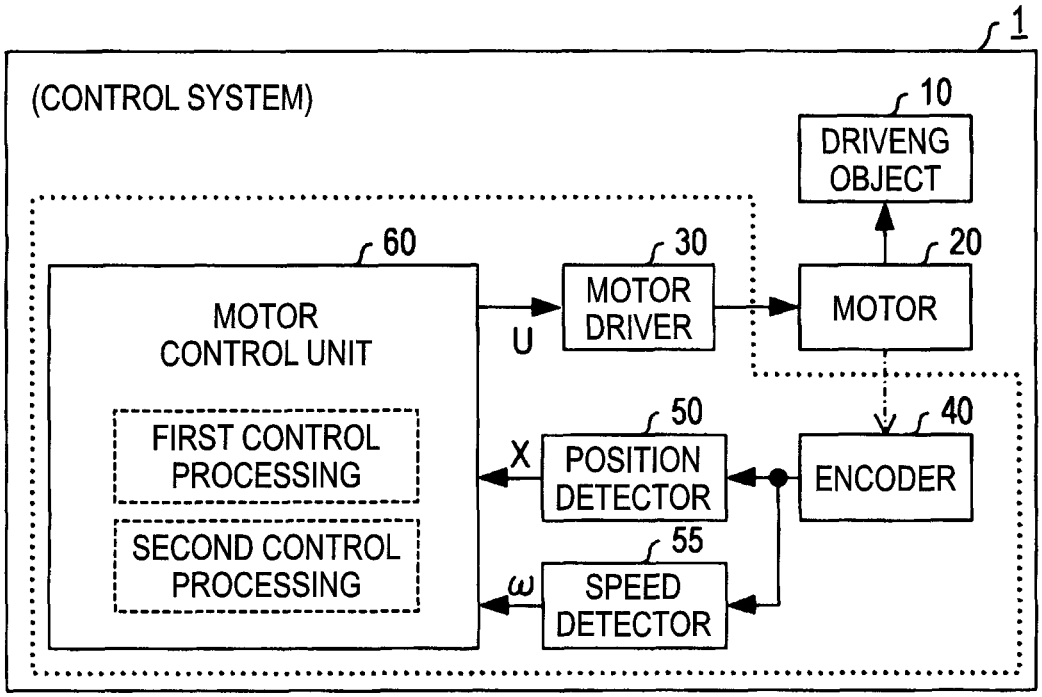
FIG. 1 illustrates a block diagram showing a configuration of a control system.

As shown in FIG. 1, a control system 1 of an illustrative embodiment has a motor (direct-current motor) 20 that drives a driven object 10, a motor driver 30, a rotary encoder 40 that is connected to a rotational shaft of the motor 20, a position detector 50 that detects a rotating position X of the motor 20 and a speed detector 55 that detects rotating speed ω of the motor 20, based on output signals of the rotary encoder 40, and a motor control unit 60 that calculates a current instruction value U that is a control input for the motor 20.

The control system 1 is built into an electrical apparatus such as image forming apparatus and the like and controls the motor in accordance with an instruction that is input from a control unit (main microcomputer and the like) of the electrical apparatus. Specifically, a sheet conveyance mechanism as the driven object 10 is provided in the image forming apparatus.

Figure 2:
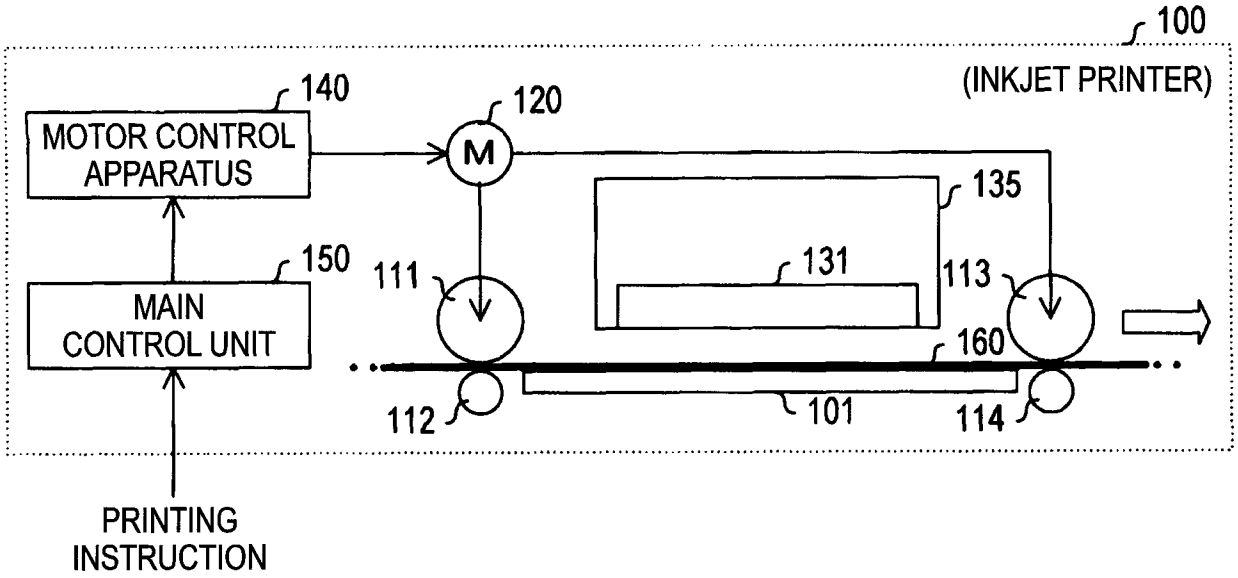
FIG. 2 illustrates a configuration of an inkjet printer.

FIG. 2 illustrates a configuration of an inkjet printer 100 as the image forming apparatus. The inkjet printer 100 shown in FIG. 2 has a conveyance roller 111 and a pinch roller 112 at an upstream side of a platen 101 and a sheet discharge roller 113 and a pinch roller 114 at a downstream side of the platen 101. Also, a recording head (such as inkjet head) 131 capable of forming an image on a sheet 160 and a carriage 135 for conveying the recording head 131 are provided above the platen 101. In addition, the inkjet printer 100 has a motor 120 for driving the conveyance roller 111 and the sheet discharge roller 113, a motor control apparatus 140 that controls the motor 120 and a main control unit 150 that inputs instructions to respective units of the apparatus including the motor control apparatus 140 and collectively controls the inkjet printer 100.

In the inkjet printer 100, the sheet conveyance mechanism is mainly configured by the rollers 111 to 114. The conveyance roller 111 and the sheet discharge roller 113 are applied with power from the motor 120 and are rotated with interlocking. The sheet 160 is fed to the sheet conveyance mechanism from a sheet feeding tray (not shown). The fed sheet 160 is held between the conveyance roller 111 and the pinch roller 112 and is conveyed to a downstream side (refer to thick arrow direction in FIG. 2) by rotation of the conveyance roller 111. Also, the sheet 160, which is conveyed by the rotation of the conveyance roller 111 and thus reaches the sheet discharge roller 113, is held between the sheet discharge roller 113 and the pinch roller 114 and is conveyed downstream by rotation of the sheet discharge roller 113. By the synchronous operation of the conveyance roller 111 and the sheet discharge roller 113, the sheet 160 is discharged to a sheet discharge tray (not shown).

Also, an ink droplet discharging operation is performed for the sheet 160 being conveyed as described above on the platen 101 by the recording head 131. In the inkjet printer 100, when a printing instruction is received from the outside, the main control unit 150 inputs a driving instruction to the motor control apparatus 140 to rotate the conveyance roller 111 and the sheet discharge roller 113 by a predetermined amount, in order to form an image based on image data of a printing object designated by the printing instruction on the sheet 160. Thereby, the motor control apparatus 140 controls the motor 120 so that the conveyance roller 111 and the sheet discharge roller 113 are rotated by a predetermined amount.

The main control unit 150 repeatedly executes the driving instruction input, thereby sending the sheet 160 to an image forming position predetermined amount by predetermined amount by the recording head 131 by the motor control apparatus 140. As sending the sheet 160 predetermined amount by predetermined amount, the main control unit conveys the recording head 131 in a main scanning direction (a direction normal to the paper surface of FIG. 2) orthogonal to the conveyance direction of the sheet 160. During the conveyance, the main control unit enables the recording head 131 to execute the ink droplet discharging operation based on the image data of the printing object, thereby forming an image based on the image data of the printing object on the sheet 160 on the platen 101.

The inkjet printer 100 shown in FIG. 2 sends the sheet 100 predetermined amount by predetermined amount as described above and then repeats the operation of forming an image on the sheet 160, thereby forming a series of images based on the image data of the printing object on the sheet 160.

The control system 1 of this illustrative embodiment is applied to the motor control apparatus 140 that controls the motor 120 of the inkjet printer 100, for example. That is, the elements (elements in the broken line of FIG. 1) except for the driven object 10 and the motor 20 of the control system 1 may be incorporated into the inkjet printer 100, as the motor control apparatus 140. In this case, the motor 120 of the inkjet printer 100 corresponds to the motor 20 of the control system 1. The conveyance roller 111 and the sheet discharge roller 113 correspond to the driven object 10.

In the inkjet printer 100, the sheet 160 is sent predetermined amount by predetermined amount and then an image is formed on the sheet 160. Accordingly, if the sheet 160 is not conveyed predetermined amount by predetermined amount with high precision, a quality of the image to be formed on the sheet 160 is deteriorated. In the meantime, a user wants a high-speed printing. In case that the control system 1 of this illustrative embodiment is applied to a control system of a driven object, for which the high speed and the high precision are required, the effects are exhibited.

That is, when the configuration of the control system 1 of this illustrative embodiment is adopted in the inkjet printer 100, it is possible to send the sheet predetermined amount by predetermined amount with high precision and at high speed, as described below. Therefore, when the configuration of the control system 1 of this illustrative embodiment is applied to the sheet conveyance mechanism of the inkjet printer 100, it is possible to improve a throughput of a series of image forming processing while suppressing the deterioration of the image.

In the below, the configuration of the control system 1 of this illustrative embodiment will be specifically described. The motor driver 30 (refer to FIG. 1) of the control system 1 inputs a driving current corresponding to a current instruction value U, which is input from the motor control unit 60, to the motor 20 in accordance with the current instruction value U, thereby driving the motor 20.

In the meantime, the rotary encoder 40 is a well-known rotary encoder that is connected to the rotational shaft of the motor 20 and outputs a pulse signal when the motor 20 rotates by a predetermined amount. The rotary encoder 40 outputs, as the pulse signal, an A-phase signal and a B-phase signal whose phases are different by $\pi/2$. The position detector 50 detects the rotating position X of the motor 20, based on the A-phase signal and the B-phase signal output from the rotary encoder 40. Then, the position detector inputs information of the detected rotating position X into the motor control unit 60. Also, the speed detector 55 detects the rotating speed ω of the motor 20, based on the A-phase signal and the B-phase signal output from the rotary encoder 40 and inputs the corresponding information into the motor control unit 60.

When a driving instruction is input from the outside (for example, main control unit 150), the motor control unit 60 drives the driven object 10 by a target driving amount Pt, which is designated together with the driving instruction, in accordance with the target driving amount Pt, and then places the sheet 160 at a target stop position corresponding to the target driving amount Pt.

Figure 3:
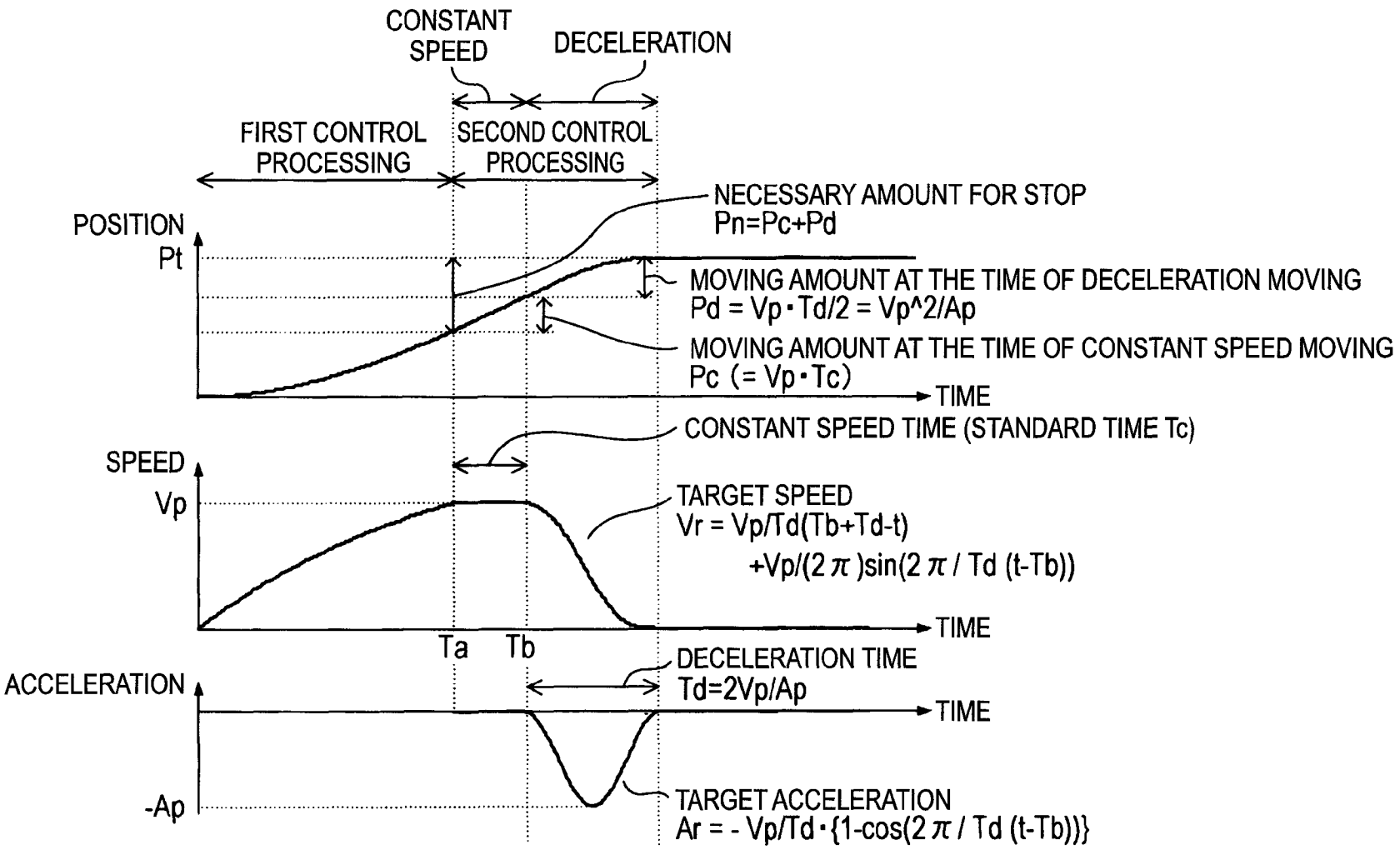
FIG. 3 is a graph illustrating trajectories of position, speed and acceleration of a driven object, which are realized in the control system.

Specifically, when the driving instruction is input, the motor control unit 60 executes first control processing and second control processing having different control ways with switching based on a predetermined condition, which will be described later, so as to drive the driven object 10 to a position corresponding to the target driving amount Pt. That is, as shown in FIG. 3, the motor control unit executes the first control processing at an early stage of the driving control starting and executes the second control processing, instead of the first control processing, after a predetermined condition is satisfied.

In the first control processing, the motor control unit calculates a current upper limit Umax, which is able to input to the motor 20 and is adjusted by current degradation by counter-electromotive force at the current rotating speed ω, based on the information of the rotating speed ω of the motor 20 input from the speed detector 55. The upper limit Umax is calculated by a predetermined calculation equation Um(ω), and a current instruction value U (=Umax) corresponding to the calculated current upper limit Umax is input to the motor driver 30. By this control, the motor control unit drives the driven object 10 at a maximum capability of the motor 20 or equivalent thereto.

In the meantime, the calculation equation Um(ω), by which the current upper limit Umax can be calculated, may be obtained beforehand by a theory or experiment at a design stage. Specifically, when determining the calculation equation Um(ω) by a theory, it may be determined by a following equation, based on a rated voltage Vmax of the motor 20, an electromotive force coefficient Ke of the motor 20 and an armature resistance Ra.

[equation 1]

$$U_m(\omega) = \frac{V_{max} - K_e \cdot \omega}{R_a} \tag{1}$$

Figure 4:
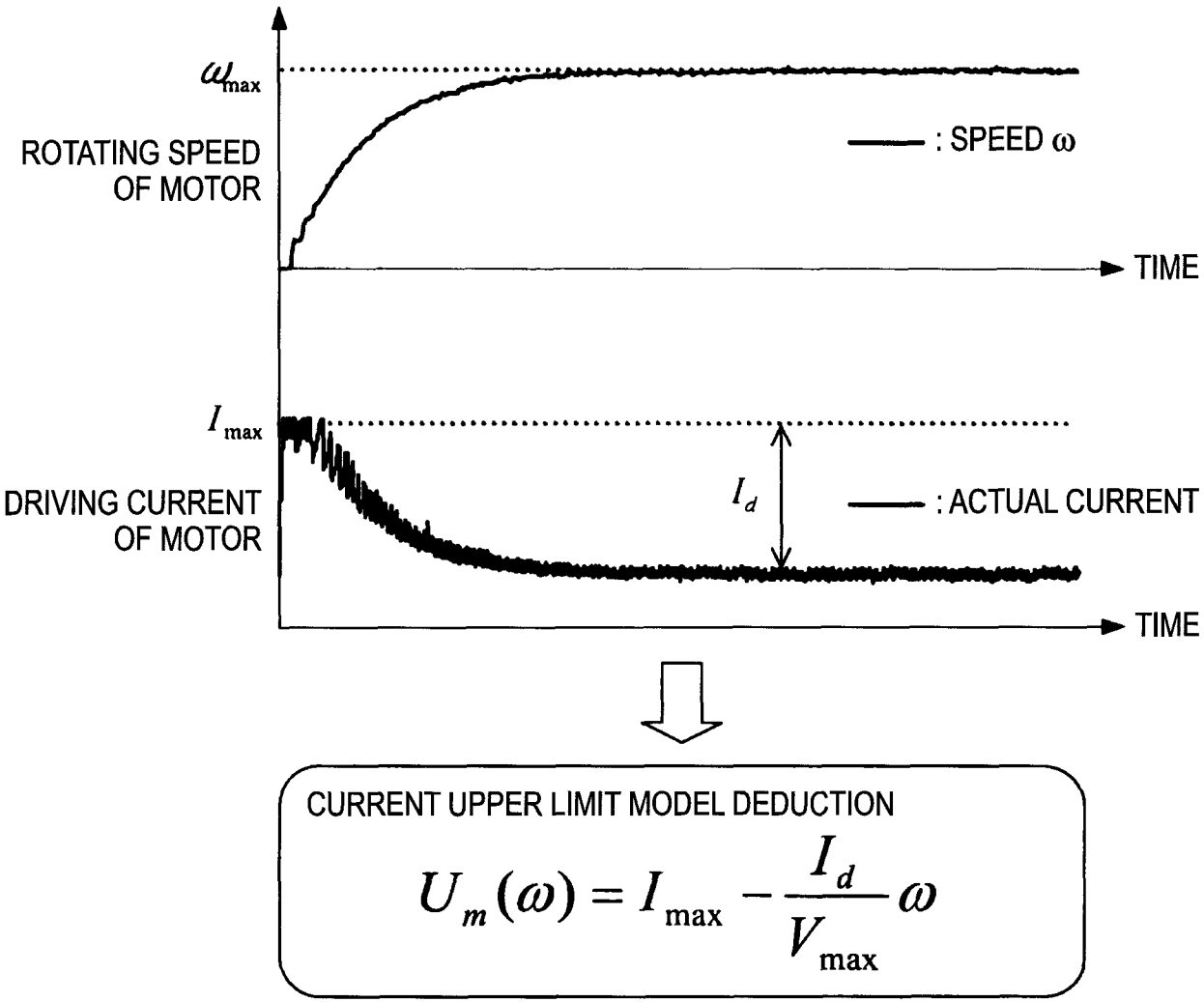
FIG. 4 illustrates a method of deducing a function Um(ω) for calculating a current upper limit Umax.

In case that the calculation equation Um(ω) is determined by an experiment, as shown in FIG. 4, the calculation equation Um(ω) may be determined by a following equation, based on the maximum rotating speed $\omega_{max}$ of the motor 20, which is obtained by driving the motor 20 with a maximum current amount $I_{max}$ that is able to be input to the motor 20 at a state in which there is no influence of the counter-electromotive force, i.e., a maximum current amount Imax that is able to be input when the rotating speed of the motor 20 is zero, and a current degradation amount $I_d$ from the maximum current amount $I_{max}$ of driving current flowing in the motor 20 at the time of the maximum rotating speed.

[equation 2]

$$U_m(\omega) = I_{max} - \frac{I_d}{\omega_{max}} \cdot \omega \tag{2}$$

The designer can freely select which the calculation equation Um(ω) by the theory or experiment is used for determination. However, when calculating the calculation equation Um(ω) by the theory, there is a possibility that the current upper limit Umax cannot be correctly calculated based on the calculation equation Um(ω), due to an error of a catalog value. Therefore, it is preferably to determine the calculation equation Um(ω) by the experiment.

Also, when executing the second control processing instead of the first control processing, the motor control unit 60 calculates the current instruction value U so that the position P and speed V of the driven object 10 follow the target profiles, based on a position (driving amount) P on the basis of a conveyance starting point of the driven object 10 specified from the rotating position X of the motor 20 detected by the position detector 50, speed V of the driven object 10 specified from the rotating speed ω of the motor 20 detected by the speed detector 55, and target profiles (i.e., target trajectories) of the position P and speed V of the driven object 10. Then, the motor control unit inputs this current instruction value U to the motor driver 30. By this operation, the motor control unit 60 controls the position P and speed V of the driven object 10 to be target values.

Specifically, in the second control processing, the motor control unit 60 may be configured to calculate the current instruction value U by using a feed-back control system or a two-degrees-of-freedom control system configured by both a feed-back control system and a feed-forward control system. In the meantime, a function for calculating the current instruction value U may be arbitrarily determined by a well-known method, based on characteristics of the driven object 10.

In this illustrative embodiment, the motor control unit switches and executes the first control processing and the second control processing, thereby driving the driven object 10 to a position corresponding to the target driving amount Pt at high speed and with high precision.

At this time, in this illustrative embodiment, as shown in FIG. 3, after starting the second control processing, the motor control unit moves the driven object 10 at constant speed without immediately decelerating the driven object 10 and then decelerates and stops the driven object 10, thereby controlling the motor 20 so as to stop the driven object 10 at the position corresponding to the target driving amount Pt with high precision. That is, in the second control processing of this illustrative embodiment, the motor control unit decelerates and stops the driven object 10 by using a target profile including a constant speed section and a deceleration section.

In the first control processing, the motor control unit inputs the current instruction value U corresponding to the current upper limit Umax to the motor driver 30 and thus drives the driven object 10 at the maximum capability of the motor 20 or equivalent thereto. Accordingly, it is difficult to decelerate and stop the driven object 10 in good precision even when it is intended to immediately decelerate the driven object 10 in the second control processing. Thus, in this illustrative embodiment, the constant speed section is provided before the deceleration. Thereby, it is possible to decelerate the driven object 10 with high precision in accordance with the target profile and to thus stop the driven object 10 at the position corresponding to the target driving amount Pt in good precision.

Also, in this illustrative embodiment, in order to decelerate and stop the driven object 10 at the maximum capability of the motor 20 or equivalent thereto, a target profile of the deceleration section is set so that a peak of target acceleration Ar in the deceleration section becomes a uniform value −Ap corresponding to the maximum capability of the motor 20, irrespective of the speed V of the driven object 10 at the start of deceleration. That is, in this illustrative embodiment, the target profile of the deceleration section is set so that a time length (deceleration time) Td of the deceleration section becomes a value corresponding to the speed V of the driven object 10 at the start of deceleration. Thereby, it is possible to decelerate and stop the driven object 10 at the maximum capability of the motor 20 or equivalent thereto. In this illustrative embodiment, since the above method of decelerating and stopping the driven object 10 is adopted, the time during which the driven object 10 can be accelerated by the first control processing is prolonged. As a result, it is possible to stop the driven object 10 at the target position at high speed.

Specifically, in this illustrative embodiment, when a standard target profile (hereinafter, referred to as 'standard profile') is used to execute the second control processing and to thus decelerate and stop the driven object 10, a necessary amount for stop Pn that is a moving amount (distance) of the driven object 10 from the start of the second control processing to the stop time thereof is calculated. In the meantime, a remaining driving amount Ps that is obtained by subtracting a driving amount P at this time from the target driving amount Pt is calculated. Then, when the remaining driving amount Ps becomes the necessary amount for Pn stop or smaller, the control on the driven object 10 is switched from the first control processing to the second control processing. According to this operation, the driven object 10 is driven for a long time by the current upper limit Umax, so that the driven object 10 is driven at high speed for the target driving amount Pt.

In the meantime, the 'standard profile' is a target profile in which a time length (constant speed time) of the constant speed section is set to be standard time Tc. This standard profile includes a target acceleration Ar, target speed Vr and a target position Pr of the driven object 10 at each time in the constant speed section, and a target acceleration Ar, target speed Vr and a target position Pr of the driven object 10 at each time in the deceleration section, which are determined as follows.

Herein, time (elapsed time) from the start of the driving control on the driven object 10 is indicated by a symbol t, start time of the constant speed section is indicated by a symbol Ta, start time of the deceleration section is indicated by a symbol Tb, and a time length (deceleration time) of the deceleration section is indicated by a symbol Td. Also, the position P of the driven object 10 at the end of the first control processing is indicated by a symbol Pm and the speed of the driven object 10 at the end of the first control processing is indicated by a symbol Vp.

Specifically, in the time domain (constant speed section) from time Ta to time Tb=Ta+Tc and in the time domain (deceleration section) from time Tb to time Tb+Td, the target accelerations Ar, the target speeds Vr and the target positions Pr of the 'standard profile' are determined as follows.

<Constant speed section>

Target acceleration Ar=0

Target speed Vr=Vp

Target position Pr=Vp·(t−Ta)+Pm

<Deceleration section)

Target acceleration

[equation 3]

$$A_r = -\frac{V_p}{T_d}\left\{1-\cos\left(\frac{2\pi}{T_d}(t-T_b)\right)\right\} \tag{3}$$

Target speed

[equation 4]

$$V_r = \int_{T_b}^{t} A_r dt + V_p \tag{4}$$

Target position

[equation 5]

$$P_r = \int_{T_b} V_r dt + P_m + V_P(T_b - T_a) \tag{5}$$

The deceleration time Td is a value Td=2·Vp/Ap, at which the acceleration peak in the deceleration section becomes a uniform value −Ap. When the second control processing is executed in accordance with the standard profile, the necessary amount for stop Pn is calculated by following equations using the speed Vp of the driven object 10 at the end of the first control processing.

$$Pn = Pc + Pd \tag{6}$$

$$Pc = Vp \cdot Tc \tag{7}$$

$$Pd = Vp^2/Ap \tag{8}$$

Here, Pc indicates a moving amount (moving amount at the time of constant speed moving) of the driven object 10 in the constant speed section, and Pd indicates a moving amount (moving amount at the time of deceleration moving) of the driven object 10 in the deceleration section.

Accordingly, by using the speed V of the driven object 10 at the time of the determination, the motor control unit 60 compare the necessary amount for stop Pn (=V·Tc+$V^2$/Ap), at a time that the control on the driven object 10 is switched from the first control processing to the second control processing at the speed V, with the remaining driving amount Ps (=Pt−P) that is specified by the position (driving amount) P of the driven object 10 at the time of the determination. According to the above comparison, the motor control unit 60 determines whether or not to switch the control on the driven object 10 from the first control processing to the second control processing When the remaining driving amount Ps is equal to or smaller than the necessary amount for stop Pn, the motor control unit starts the second control processing. In the second control processing, the motor control unit adjusts the constant speed time Tc of the standard profile and controls the driven object 10, based on the adjusted target profile (target trajectory). By this operation, in this illustrative embodiment, the driven object 10 is stopped at the target position with high precision. In the meantime, the standard profile and the adjusted target profile, which is actually used in the second control processing, are different from each other in that, for example, the constant speed time is the standard time Tc or the other value Tcr.

In the below, processing, which is periodically executed by the motor control unit 60 so as to control the driven object 10 at a time when the driving instruction is input, will be specifically described with reference to FIG. 5. When the processing shown in FIG. 5 starts, the motor control unit 60 first determines whether a flag F is set to be value 1 (one) (S110). In the meantime, the flag F is reset to be a value 0 (zero) when the driving instruction is input and is set to be value 1 when processing of S190 is executed.

When it is determined that the flag F is zero (No in S110), the motor control unit 60 specifies the position (driving amount) P of the driven object 10 at this time based on the rotating position X of the motor 20 detected by the position detector 50, and the motor control unit 60 also specifies the speed V of the driven object 10 at this time, based on the rotating speed ω of the motor 20 detected by the speed detector 55 (S120). Since the motor 20 and the driven object 10 are coupled to each other, it is obviously possible to specify the position P and speed V of the driven object 10 from the rotating position X and rotating speed ω of the motor 20.

After that, the motor control unit 60 calculates the moving amount Pc (=V·Tc) of the driven object 10 at the time of constant speed moving and the moving amount Pd ($=V^2/Ap$) at the time of deceleration moving, based on the current speed V of the driven object 10, when the motor control unit controls the driven object 10 from that time in accordance with the standard profile (S130). Then, based on the calculated values, the motor control unit calculates the necessary amount for stop Pn (=Pc+Pd) when the motor control unit controls the driven object 10 from that time in accordance with the standard profile (S135).

Also, based on the current position P of the driven object 10 and the target driving amount Pt, the motor control unit 60 calculates the remaining driving amount Ps (=Pt·P) to the position corresponding to the target driving amount Pt (S140) and determines whether the remaining driving amount Ps is equal to or smaller than the necessary amount for stop Pn (S150).

When it is determined that the remaining driving amount Ps is larger than the necessary amount for stop Pn (No in S150), the motor control unit proceeds to S160 and executes the first control processing to input the current instruction value U (=Umax) corresponding to the current upper limit Umax to the motor driver 30. By this control, when the remaining driving amount Ps is larger than the necessary amount for stop Pn, the motor control unit drives the driven object 10 at the maximum capability of the motor 20 or equivalent thereto. After that, the processing shown in FIG. 5 ends and again executes the processing shown in FIG. 5 at a next execution timing that periodically comes.

In repeating the processing shown in FIG. 5, a timing, at which the remaining driving amount Ps is equal to or smaller than the necessary amount for stop Pn, comes. At the timing, the motor control unit 60 determines in the affirmative in S150 (Yes in S150) and proceeds to S170. In S170, the motor control unit stores the current time t as the start time Ta of the constant speed section, stores the position P of the driven object 10 at this time as the position Pm of the driven object 10 at the end of the first control processing, and stores the speed V of the driven object 10 at this time as the speed Vp of the driven object 10 at the end of the first control processing.

Also, the motor control unit 60 calculates a adjustment value Tcr of the constant speed time (hereinafter, referred to as 'adjusted constant speed time') by a following equation, so as to perform the driving control on the driven object 10 suiting current conditions in the second control processing (S175).

$$Tcr=(Pt-Pm-Pd)/Vp \quad (9)$$

In the second control processing of this illustrative embodiment, as described above, without changing the shape of the target profile of the deceleration section in the standard profile, the time length (constant speed time) of the constant speed section is adjusted from the standard time Tc, so that the target profile suiting the current conditions is set.

In S175, the time length Tcr of the constant speed section after the adjustment (adjusted constant speed time) is calculated by the equation (9). When the shape of the target profile of the deceleration section is not changed from the standard profile, the moving amount Pd at the time of deceleration in the adjusted target profile coincides with the value calculated in S130 based on the standard profile. Accordingly, by the value (Pt−Pm−Pd), the appropriate moving amount of the driven object 10 from the current position to the start time of the deceleration section is calculated, so that the appropriate adjusted constant speed time Tcr is calculated at the position Pm of the driven object 10 at this time by the equation (9).

When the adjusted constant speed time Tcr is calculated as described above, the motor control unit 60 sets the deceleration time Td (=2·Vp/Ap) corresponding to the current speed Vp of the driven object so that the acceleration peak in the deceleration section becomes a prescribed value −Ap (S180).

Figure 7:
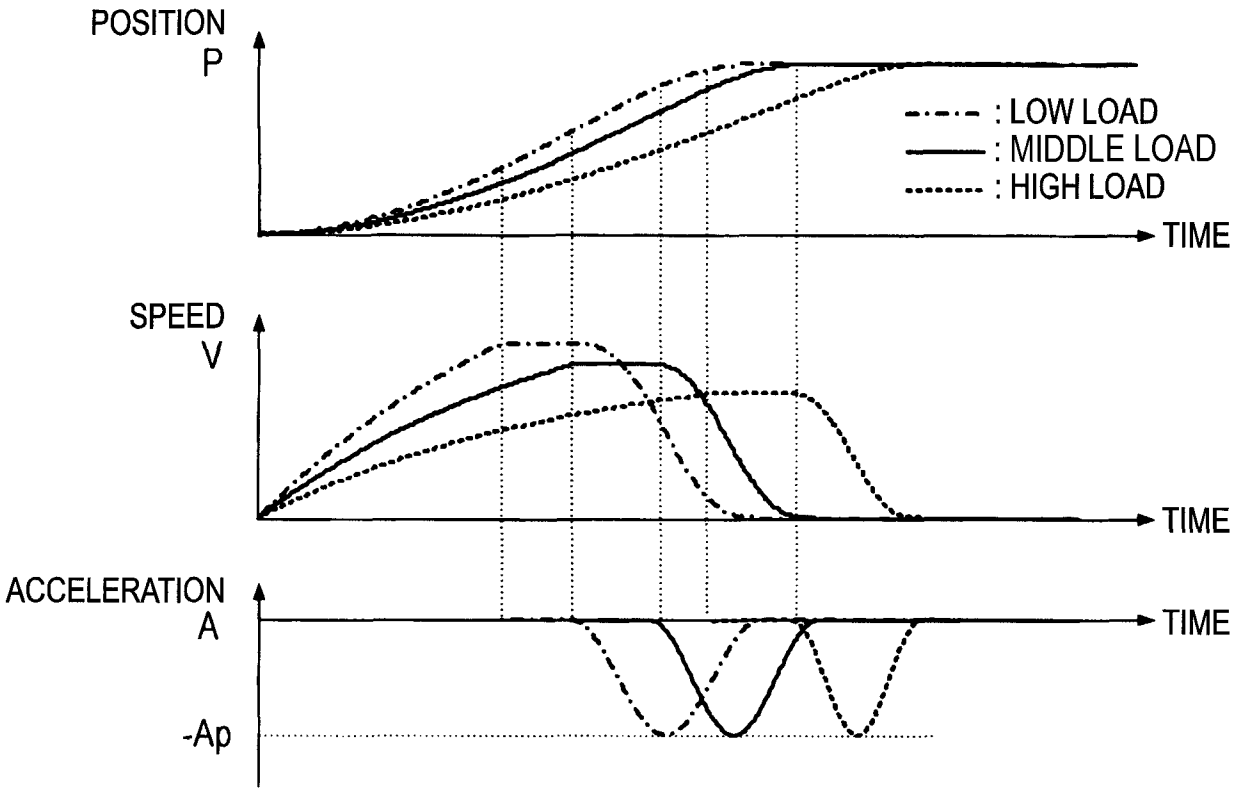
FIG. 7 is a graph illustrating trajectories of position, speed and acceleration of a driven object, which are realized in the control system, showing the trajectories for each load level.

By the setting of the deceleration time Td, as shown in FIG. 7, the acceleration peak in the deceleration section coincides with the prescribed value −Ap, irrespective of the speed Vp of the driven object 10 at the start of the second control processing. In the meantime, FIG. 7 is a graph illustrating trajectories of the position, speed and acceleration of the driven object, which are realized in the first control processing and the second control processing, and illustrating the trajectories for each load level. The speed Vp of the driven object 10 at the start of the second control processing is changed depending on the load levels that are applied to the driven object 10. However, in this illustrative embodiment, the deceleration time Td is set so that the peak of the acceleration in the deceleration section uniformly becomes the limit value −Ap of the acceleration realizable in the motor 20, irrespective of the load levels.

Also, after setting the deceleration time Td, the start time Tb of the deceleration section is set to be a value Tb=Ta+Tcr that is obtained by adding the start time Ta of the constant speed section with the adjusted constant speed time Tcr thereto (S185) and sets the flag F to be value 1 (S190). After that, the motor control unit proceeds to S200 and starts the second control processing shown in FIG. 6.

Figure 6:
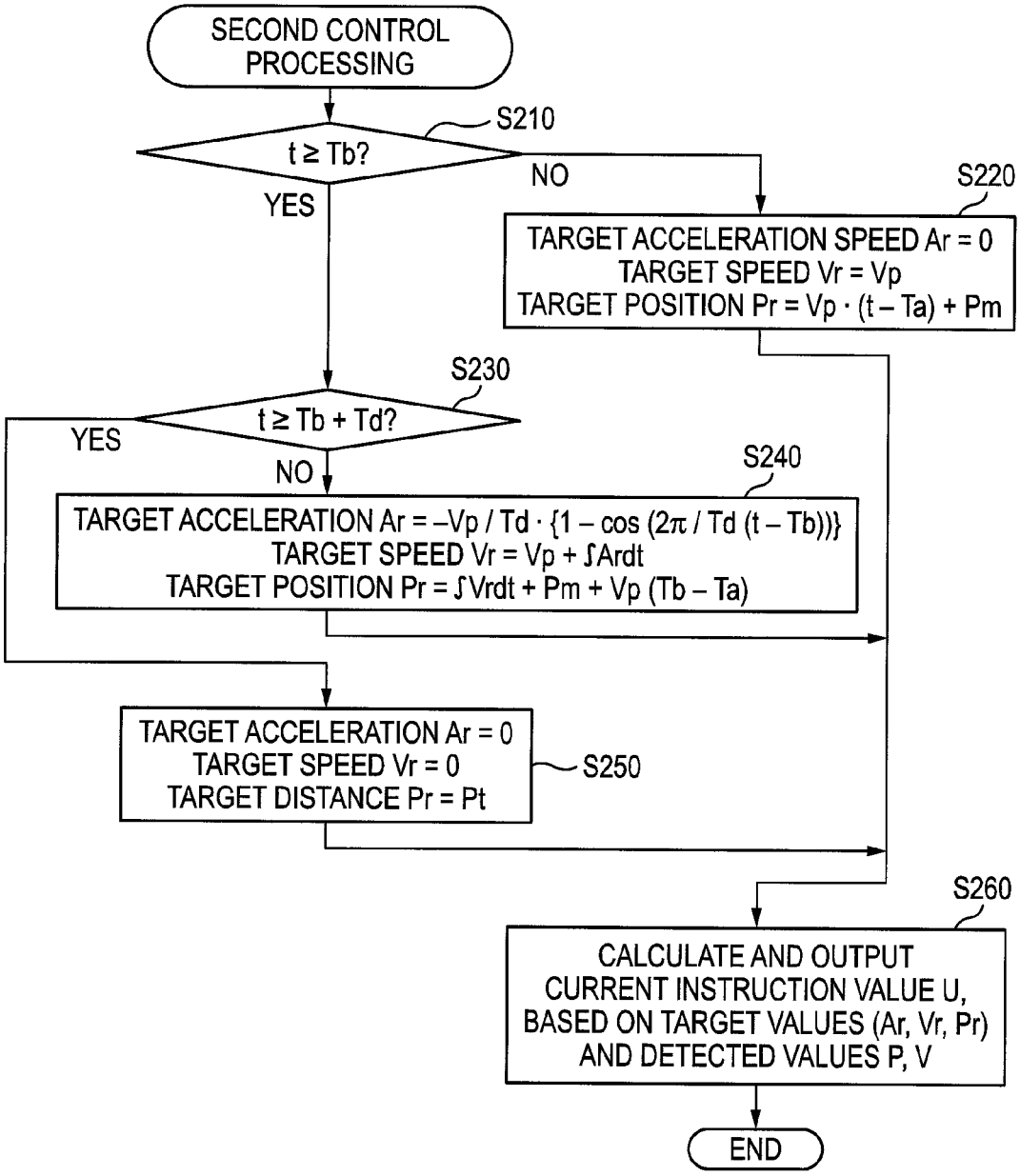
FIG. 6 is a flowchart illustrating second control processing executed by the motor control unit 60.

When the second control processing shown in FIG. 6 starts, the motor control unit 60 determines whether the start time Tb of the deceleration section has come based on the current time t (S210). When it is determined that the start time Tb of the deceleration section has not come (t<Tb) (No in S210), in accordance with the above-described target profile, the motor control unit sets the target acceleration Ar, which is a target value of the acceleration A of the driven object 10, to be zero (Ar=0), sets the target speed Vr, which is a target value of the speed V of the driven object 10, to be Vr=Vp, and sets the target position Pr, which is a target value of the position P of the driven object 10, to be Pr=Vp·(t−Ta)+Pm (S220). When the processing proceeds to S260, based on the set target values (target acceleration Ar, target speed Vr and target position Pr) and the position P and speed V of the driven object 10 at this time, the motor control unit 60 calculates the current instruction value U about the motor 20 so as to reduces an error between the position P and speed V of the driven object 10 and the target values thereof in accordance with a predetermined function, and the motor control unit 60 inputs the calculated current instruction value U to the motor driver 30. Then, the second control processing ends.

By the above processing, the motor control unit 60 controls the driven object 10 (i.e., controls the motor 20) so that the driven object 10 moves at constant speed of the speed Vp in the time section from the time t=Ta to the time t=Tb.

In the meantime, when it is determined that the start time Tb of the deceleration section has come (t≥Tb) (Yes in S210), the motor control unit 60 determines whether the end time Tb+Td of the deceleration section has come, based on the current time t (S230). When it is determined that the end time Tb+Td of the deceleration section has not come (t<Tb+Td) (No in S230), the motor control unit sets the target acceleration Ar by the equation (3), sets the target speed Vr by the equation (4) and sets the target position Pr by the equation (5) (S240).

When the processing proceeds to S260, the motor control unit 60 calculates the current instruction value U about the motor 20 so as to reduce an error between the position P and speed V of the driven object 10 and the target values thereof, by assigning the set target values (target acceleration Ar, target speed Vr and target position Pr) and the position P and speed V of the driven object 10 at this time into a predetermined function, and inputs the calculated current instruction value U to the motor driver 30. Then, the second control processing ends.

By the above processing, the motor control unit 60 decelerates and stops the driven object 60 through the motor 20 so that the acceleration peak at the time of deceleration becomes the value −Ap (refer to FIGS. 3 and 7) in the time section from the time t=Tb to the time t=Tb+Td and the acceleration A and the speed V at the time t=Tb+Td become zero and the position P at the time t=Tb+Td coincides with the driving amount Pt.

Also, when it is determined that the end time t=Tb+Td of the deceleration section has come (Yes in S230), the motor control unit 60 sets the target acceleration Ar to be zero (Ar=0), sets the target speed Vr to be zero (Vr=0) and sets the target position Pt to be Pt (Pr=Pt) (S250). When the processing proceeds to S260, the motor control unit 60 calculates the current instruction value U so that the position P and speed V of the driven object 10 coincide with the target values (target acceleration Ar, target speed Vr and target position Pr), and inputs the calculated current instruction value U to the motor driver 30. After that, the second control processing ends.

The motor control unit 60 periodically and repeatedly executes the processing shown in FIG. 5 including the above second control processing, and the motor control unit 60 ends the periodic processing when a control ending condition is satisfied. By this operation, the driven object 10 is stopped at the position corresponding to the target driving amount Pt with high precision. For example, when the position P of the driven object 10 obtained from the position detector 50 is not changed for a predetermined time period, the motor control unit 60 considers that the driven object 10 has stopped and ends the periodic processing.

The configuration of the control system 1 of this illustrative embodiment has been described. According to this illustrative embodiment, at the early stage of the driving control of driving and arranging the driven object 10 at the target stop position, the current upper limit Umax that is able to be input to the motor 20 is estimated and the motor 20 is driven with the driving current corresponding to the current upper limit Umax. Therefore, it is possible to drive the driven object 20 at high speed.

Further according to this illustrative embodiment, the necessary amount for stop Pn and the remaining driving amount Ps are compared, so that the switching timing to the second control processing is adjusted. Therefore, it is possible to lengthen the motor driving at the current upper limit Umax within a range in which it is expected that the stopping accuracy will not be deteriorated. Also, in this illustrative embodiment, in order to execute the motor driving at the current upper limit Umax for a long time, the acceleration peak at the time of deceleration is uniformly adjusted to the limit value −Ap, which is the acceleration realizable by the motor 20. Therefore, it is possible to decelerate and stop the driven object 20 by fully using the capability of the motor 2, so that it is possible to stop the driven object 20 at the target stop position at high speed and with high precision.

For example, according to this illustrative embodiment, as shown in FIG. 7, when the load level for the driven object 10 is low and the driven object 10 is favorably accelerated by the first control processing, the deceleration time Td is set to be long corresponding to the capability of the motor 20. On the other hand, when the load level for the driven object 10 is high and the driven object 10 is not accelerated so much by the first control processing, the deceleration time Td is set to be short, so that the execution time of the first control processing is set to be long. Thus, according to this illustrative embodiment, it is possible to appropriately switch the first control processing and the second control processing depending on the load change influencing the driven object 10 and to effectively utilize the capability of the motor 20, thereby realizing the driving of the driven object 10 to the target stop position at high speed and with high precision.

Accordingly, when the configuration of the control system 1 is incorporated into the image forming apparatus such as inkjet printer 100, it is possible to convey the sheet at high speed and with high precision, so that it is possible to realize an image formation of high precision while improving the throughput of the image formation. In particular, in the image forming apparatus, since the above-described load is apt to change depending on qualities of the sheet, when the configuration of the control system 1 is adopted, the effects thereof are effectively exhibited.

In the meantime, the correspondence relation between the terms is as follows. That is, the motor control unit 60 corresponds to an example of the motor control unit, and the encoder 40 corresponds to an example of the signal output unit. Also, the first control processing executed by the motor control unit 60 corresponds to an example of the processing executed by the first control unit, and the second control processing and the processing of S170 to S185 and the like that are executed by the motor control unit 60 correspond to an example of the processing executed by the second control unit. In addition, the processing of S110, S150 and S190 executed by the motor control unit 60 corresponds to an example of the processing realized by the switching unit, the processing of S130 and S150 executed by the motor control unit 60 corresponds to an example of the processing realized by the first calculation unit, and the processing of S140 corresponds to an example of the processing realized by the second calculation unit.

Also, this disclosure is not limited to the above illustrative embodiment and can be adapted to a variety of aspects. For example, in the above illustrative embodiment, the position P and speed V of the driven object 10 are specified from the rotating position X of the motor 20 detected by the position detector 50 and the rotating speed ω of the motor 20 detected by the speed detector 55, and the driven object 10 is controlled so that the position P and speed V suit the target values thereof. However, the rotating position X and rotating speed ω of the motor 20 and the position P and speed V of the driven object 10 merely has different measurements, respectively. Thus, it may be possible to directly use the rotating position X of the motor 20 detected by the position detector 50 and the rotating speed ω of the motor 20 detected by the speed detector 55 and to perform the motor control so that the rotating position and the rotating speed suit the target values thereof, thereby indirectly controlling the driven object 10.

Also, in the above illustrative embodiment, the rotary encoder 40 is connected to the rotational shaft of the motor 20 and the position P and speed V of the driven object 10 are specified from the rotating position X and rotating speed ω of the motor 20. However, the rotary encoder 40 may be connected to the driven object 10 and the position P and speed V of the driven object 10 may be directly detected from the rotary encoder 40. For example, the rotary encoder 40 is connected to the rotational shaft of the conveyance roller 111. In this case, the rotating position X and rotating speed ω of the motor 20 are specified from the position P and speed V of the driven object 10.

Also, this disclosure is not limited to the above configuration in which the control system 1 of the above illustrative embodiment is applied to the inkjet printer 100. Also, in the above illustrative embodiment, both the position P and the speed V of the driven object 10 are used to perform the control based on the target profile. However, only one of the position P and the speed V of the driven object 10 may be used to perform the control based on the target profile. Also, in the above illustrative embodiment, the acceleration peak at the time of deceleration is uniformly adjusted to the limit value −Ap of the acceleration realizable by the motor 20. However, the acceleration peak may be adjusted to any value other than the limit value insofar as the necessary amount for stop can be calculated, and it may be possible to operate the driven object other than the above operation pattern of constant speed and then deceleration.

What is claimed is:

1. A motor control apparatus comprising:

a motor control unit configured to control a motor; and a signal output unit configured to output a signal corresponding to rotation of the motor, wherein the motor control apparatus is configured to displace an object to be driven to a target stop position by controlling the motor based on the output signal of the signal output unit, wherein the motor control unit is configured to execute:

a first control process that determines a first control input corresponding to an estimated current upper limit which is an upper limit of a current that is able to be input to the motor;

a second control process that determines a second control input, based on a difference between a detected value specified from the output signal of the signal output unit and a target value of a target trajectory that has a constant speed section, in which the object is driven at constant speed where an initial speed corresponds to a speed at an end of the motor control by the first control process, and a deceleration section, which is a section for deceleration after the constant speed section, wherein the second control input is applied to the motor after the first control process and the second control process controls the motor to stop the object to be driven at the target stop position;

a first calculation process that calculates a necessary amount to stop, which is a displacement amount of the object to be driven from a start time of the motor control by the second control process to a stop time of the object to be driven, in a case that the motor is controlled according to the target trajectory of the second control process, based on the speed specified by the output signal of the signal output unit;

a second calculation process that calculates a remaining displacement amount of the object to be driven from that time to a time, at which the object to be driven reaches the target stop position, based on the displacement amount specified from the output signal of the signal output unit; and a switching process that determines whether a starting condition of the motor control by the second control process is satisfied, based on the necessary amount to stop calculated by the first calculation process and the remaining displacement amount calculated by the second calculation process, wherein the switching process enables the first control process to control the motor when determining that the starting condition of the motor control by the second control process is not satisfied, and enables the second control process to control the motor, instead of the first control process, when determining that the starting condition of the motor control by the second control process is satisfied.

2. The motor control apparatus according to claim 1, wherein the switching process determines that the starting condition of the motor control by the second control process is satisfied when the remaining displacement amount becomes a value corresponding to the necessary amount to stop.

3. The motor control apparatus according to claim 1, wherein the first calculation process calculates the necessary amount to stop when the second control process performs, as the motor control in accordance with a specific control pattern, motor control in accordance with a specific target trajectory that is the target trajectory in which the initial speed corresponds to the speed specified from the output signal of the signal output unit and an acceleration peak at a time of deceleration is to be a prescribed value irrespective of the initial speed.

4. The motor control apparatus according to claim 3, wherein the specific target trajectory is a target trajectory, in which the acceleration peak at the time of deceleration is set to be a value corresponding to a limit value of acceleration realizable by the motor control of the second control process.

5. The motor control apparatus according to claim 1, wherein the second control process sets a target trajectory used for the motor control, by adjusting a target trajectory corresponding to a specific control pattern, based on the remaining displacement amount at the start of the motor control by the second control process, wherein the second control process sets a target trajectory used for the motor control, in which the object to be driven is to be stopped at the target stop position, by adjusting a time length of the constant speed section without adjusting the target trajectory of the deceleration section.

6. The motor control apparatus according to claim 1, wherein, in first control process, the estimated current upper limit is calculated by subtracting a maximum current amount, which is able to be input when a rotating speed of the motor is zero, from a current degradation amount, which is proportional to the rotating speed of the motor.

7. An image forming apparatus comprising:

a motor;

a conveyance unit having a roller to be driven by the motor and configured to convey a recording medium by rotation of the roller;

an image forming unit configured to form an image on the recording medium being conveyed by the conveyance unit, and a motor control apparatus comprising:

a motor control unit configured to control a motor; and a signal output unit configured to output a signal corresponding to rotation of the motor, wherein the motor control apparatus is configured to displace an object to be driven to a target stop position by controlling the motor based on the output signal of the signal output unit, wherein the motor control unit is configured to execute:

a first control process that determines a first control input corresponding to an estimated current upper limit which is an upper limit of a current that is able to be input to the motor;

a second control process that determines a second control input, based on a difference between a detected value specified from the output signal of the signal output unit and a target value of a target trajectory that has a constant speed section, in which the object is driven at constant speed where an initial speed corresponds to a speed at an end of the motor control by the first control process, and a deceleration section, which is a section for deceleration after the constant speed section, wherein the second control input is applied to the motor after the first control process and the second control process controls the motor to stop the object to be driven at the target stop position;

a first calculation process that calculates a necessary amount to stop, which is a displacement amount of the object to be driven from a start time of the motor control by the second control process to a stop time of the object to be driven, in a case that the motor is controlled according to the target trajectory of the second control process, based on the speed specified by the output signal of the signal output unit;

a second calculation process that calculates a remaining displacement amount of the object to be driven from that time to a time, at which the object to be driven reaches the target stop position, based on the displacement amount specified from the output signal of the signal output unit; and a switching process that determines whether a starting condition of the motor control by the second control process is satisfied, based on the necessary amount to stop calculated by the first calculation process and the remaining displacement amount calculated by the second calculation process, wherein the switching process enables the first control process to control the motor when determining that the starting condition of the motor control by the second control process is not satisfied, and enables the second control process to control the motor, instead of the first control process, when determining that the starting condition of the motor control by the second control process is satisfied.

8. A motor control apparatus comprising:

a motor control unit configured to control a motor; and a signal output unit configured to output a signal corresponding to rotation of the motor, wherein the motor control apparatus is configured to displace an object to be driven to a target stop position by controlling the motor based on the output signal of the signal output unit, wherein the motor control unit is configured to execute:

a first control process that determines a first control input corresponding to an estimated current upper limit which is an upper limit of a current that is able to be input to the motor;

a second control process that determines a second control input, based on a difference between a detected value specified from the output signal of the signal output unit; and a target value of a target trajectory that has a constant speed section, in which the object is driven at constant speed where an initial speed corresponds to a speed at an end of the motor control by the first control process, and a deceleration section, which is a section for deceleration after the constant speed section, wherein the second control input is applied to the motor after the first control process and the second control process sets the target trajectory by adjusting a length of time of the constant speed section without adjusting the deceleration section based on a remaining displacement amount at a start time of the motor control by the second control process, thereby controlling the motor to stop the object to be driven at the target stop position;

a first calculation process that calculates a necessary amount to stop, which is a displacement amount of the object to be driven from the start time of the motor control by the second control process to a stop time of the object to be driven, in a case that the motor is controlled according to the target trajectory of the second control process, based on the speed specified by the output signal of the signal output unit;

a second calculation process that calculates the remaining displacement amount of the object to be driven from that time to a time, at which the object to be driven reaches the target stop position, based on the displacement amount specified from the output signal of the signal output unit; and a switching process that determines whether a starting condition of the motor control by the second control process is satisfied, based on the necessary amount to stop calculated by the first calculation process and the remaining displacement amount calculated by the second calculation process, wherein the switching process enables the first control process to control the motor when determining that the starting condition of the motor control by the second control process is not satisfied, and enables the second control process to control the motor, instead of the first control process, when determining that the starting condition of the motor control by the second control process is satisfied, wherein the first calculation process calculates the necessary amount to stop when the second control process performs, as the motor control in accordance with a specific control pattern, motor control in accordance with a specific target trajectory that is a target trajectory, in which initial speed corresponds to the speed specified from the output signal of the signal output unit and an acceleration peak at a time of deceleration is to be a prescribed value irrespective of the initial speed, wherein the second control process sets a target trajectory used for the motor control, by adjusting a target trajectory corresponding to the specific control pattern, based on the remaining displacement amount at the start of the motor control by the second control process, and wherein the second control process sets a target trajectory used for the motor control, in which the object to be driven is to be stopped at the target stop position, by adjusting a time length of the constant speed section without adjusting the target trajectory of the deceleration section.

* * * * *